US012110788B2

(12) United States Patent
Bigno

(10) Patent No.: US 12,110,788 B2
(45) Date of Patent: Oct. 8, 2024

(54) SYSTEM OF CHEMICAL IN-FLOW TRACERS FOR EARLY WATER BREAKTHROUGH DETECTION

(71) Applicant: Abu Dhabi National Oil Company, Abu Dhabi (AE)

(72) Inventor: Yann Bigno, Abu Dhabi (AE)

(73) Assignee: Abu Dhabi National Oil Company, Abu Dhabi (AE)

( * ) Notice: Subject to any disclaimer, the term of this patent is extended or adjusted under 35 U.S.C. 154(b) by 196 days.

(21) Appl. No.: 17/598,126

(22) PCT Filed: Mar. 26, 2019

(86) PCT No.: PCT/IB2019/052443
§ 371 (c)(1),
(2) Date: Sep. 24, 2021

(87) PCT Pub. No.: WO2020/194031
PCT Pub. Date: Oct. 1, 2020

(65) Prior Publication Data

US 2022/0186609 A1 Jun. 16, 2022

(51) Int. Cl.
*E21B 47/11* (2012.01)

(52) U.S. Cl.
CPC ..... *E21B 47/11* (2020.05)

(58) Field of Classification Search
CPC ..... E21B 47/11
See application file for complete search history.

(56) References Cited

U.S. PATENT DOCUMENTS

| | | | | |
|---|---|---|---|---|
| 4,659,925 | A | 4/1987 | Burbidge et al. | |
| 6,016,191 | A | 1/2000 | Ramos et al. | |
| 6,645,769 | B2 | 11/2003 | Tayebi et al. | |
| 7,347,260 | B2 | 3/2008 | Ferguson et al. | |
| 7,469,597 | B2 | 12/2008 | Flaten et al. | |
| 7,805,248 | B2 | 9/2010 | Thigpen et al. | |
| 8,275,549 | B2 * | 9/2012 | Ramirez | G01N 33/2823 702/182 |
| 2001/0036667 | A1 | 11/2001 | Tayebi et al. | |

(Continued)

FOREIGN PATENT DOCUMENTS

| | | | |
|---|---|---|---|
| CN | 1212319 | A | 3/1999 |
| CN | 100999992 | A | 7/2007 |

(Continued)

OTHER PUBLICATIONS

International Search Report mailed Jul. 4, 2019, for corresponding International Patent Application No. PCT/IB2019/052443.

(Continued)

*Primary Examiner* — Crystal J Lee
(74) *Attorney, Agent, or Firm* — Renner, Otto, Boisselle & Sklar, LLP

(57) ABSTRACT

The present invention relates to a system and a method for detecting water break-through at an oil and/or gas production site comprising two or more oil and/or gas producing well(s) (3*a*) and/or well string(s) (3*a*). The present invention utilizes chemical in-flow tracers and allows for simultaneous monitoring of water breakthrough for two or more oil and/or gas producing well(s) (3*a*) and/or well completion(s) at centralized down-stream location.

18 Claims, 6 Drawing Sheets

(56) References Cited

U.S. PATENT DOCUMENTS

| | | | | |
|---|---|---|---|---|
| 2008/0262735 | A1* | 10/2008 | Thigpen | E21B 47/10 702/6 |
| 2013/0268198 | A1* | 10/2013 | Nyhavn | G01V 9/00 702/6 |
| 2017/0370210 | A1 | 12/2017 | Nyhavn et al. | |
| 2018/0275114 | A1* | 9/2018 | Kosynkin | G01N 30/7206 |

FOREIGN PATENT DOCUMENTS

| | | | | |
|---|---|---|---|---|
| CN | 101270658 | A | 9/2008 | |
| JP | S59120814 | A | 7/1984 | |
| WO | 1999057417 | A2 | 11/1999 | |
| WO | 2001081914 | A1 | 11/2001 | |
| WO | WO-0181914 | A1 * | 11/2001 | C09K 8/03 |
| WO | 2008131210 | A2 | 10/2008 | |
| WO | 2013-154945 | A1 | 10/2013 | |
| WO | 2017162489 | A1 | 9/2017 | |

OTHER PUBLICATIONS

Written Opinion mailed Jul. 4, 2019, for corresponding International Patent Application No. PCT/IB2019/052443.

Sira, et al. "Liquid Accumulation in Gas Condensate Pipelines Measured by use of Tracer Techniques" (https://www.onepetro.org/conference-paper/BHR-2005-G5).

First Examination and Search Report issued for corresponding UAE Patent Application No. P6001710/2021, mailed Aug. 22, 2023.

First Chinese Office Action and Search Report issued for corresponding Chinese Patent Application No. 201980096145.7, mailed Nov. 1, 2023.

* cited by examiner

SYSTEM OF CHEMICAL IN-FLOW TRACERS FOR EARLY WATER BREAKTHROUGH DETECTION

This application is a national phase of International Application No. PCT/IB2019/052443, filed 26 Mar. 2019, the entire disclosure of which is hereby incorporated by reference.

FIELD OF THE INVENTION

The present invention relates to a system and a method for detecting water breakthrough at an oil and/or gas production site wherein two or more oil and/or gas producing wells and/or well strings are simultaneously monitored at a centralized downstream location and wherein one or more chemical in-flow tracer(s) are utilized for monitoring water breakthrough.

BACKGROUND OF THE INVENTION

In petroleum industry, hydrocarbonaceous subsurface reservoirs are exploited in order to produce oil and/or gas production fluids. The oil and/or gas production fluids extracted from oil and/or gas bearing subsurface formations comprise hydrocarbons, i.e. oil and/or gas, and, to a certain extent, also water. The production fluids are produced by wells which are drilled in the subsurface formation. The hydrocarbonaceous production fluids comprising oil and/or gas and water are transported from the reservoir to the surface through one or more production tubings.

Usually, in the beginning of exploiting a reservoir, the production fluid is lifted to the surface due to a pressure difference between the formation pressure and the pressure of the fluid column within the well. At a later stage of exploiting a reservoir, i.e. when the pressure of the formation is not sufficient anymore for lifting the production fluid to the surface due to reservoir depletion, pumps or injection fluids may be employed to produce the production fluids.

In oil and gas industry the term "production fluid" generally refers to gaseous or liquid hydrocarbonaceous streams comprising water only to a certain extent. However, as consequence of reservoir depletion substantial amounts of water may penetrate into the reservoir and thus also reach the well.

If large amounts of water are present in the well, this is commonly referred to as water breakthrough. Water breakthrough, i.e. immoderate amounts of water in a production well may be critical to the operation of the well, because, e.g., water production leads to losses in production capacity due to multi-phase flow and a heavier fluid column in the well, to increased surface processing costs as water separation, treatment and disposal is required, and/or to additional requirements of pressure support to the reservoir per unit of hydrocarbon production. In summary, water breakthrough may cause laborious and costly water shut-off interventions and eventually also lead to production losses.

Therefore, early detection of water breakthrough is essential to a satisfying performance of a production well and may also prolong well life.

Water breakthrough detection commonly relies on probing the production fluid at the wellhead, including analyzing the production fluid by interpretation of parameters acquired at the well-head. In some situations, water breakthrough is difficult or even impossible to detect: this is the case in the absence of well-head instrumentation, when well testing frequency is low due to limited testing facilities, or when such testing facilities have insufficient detection levels.

Probing the production fluid of an oil and/or gas reservoir is essential to provide information inter alia on the flow of a production fluid within a reservoir or the composition of the production fluid, e.g. during drilling and completion of a well, in reservoir evaluation or testing residual oil saturation. Probing the production fluid of an oil and/or gas reservoir may be a direct method such as direct measurements of physical and/or chemical properties of the production fluid. When monitoring water breakthrough, direct probing of the production fluid may be direct measurement of the water content of the production fluid at the well location. In the alternative, probing the production fluid of an oil and/or gas reservoir may be an indirect method, such as methods involving tracers in a variety of tracer experiments, e.g. in single well or in well-to-well tests.

Tracers interact physically (e.g. by adsorption, absorption, dissolution) and/or chemically (via a chemical reaction and/or transformation) with the production fluid or a specific phase or a specific component of the production fluid. Moreover, the physical and chemical tracers allow for specific detection of the tracers. Tracers known in the art may be radioactive or non-radioactive chemical compounds in solid, liquid or gaseous state. Common tracers comprise chemical tracers, radioactive tracers and/or chemical in-flow tracers. Usually, chemical or radioactive tracers are injected into a well along with a carrier fluid, e.g. injection water or injection gas, and detected at the same or at a different well such as a producing well. In contrast, chemical in-flow tracers are usually installed subsurface, e.g. in or around the borehole in a single well or a single well completion and are constantly exposed to the flow of the production fluid.

Chemical in-flow tracers are chemical compounds which react with one of the production fluid components or production fluid phases subsurface and may subsequently be detected at the surface by a downstream detecting device or may be detected via manual sampling at a downstream sampling point or sampling system and subsequent analysis. Thereby the absence, presence and quantity of a production fluid component or a production fluid phase comprising the chemical in-flow tracer may be determined.

Chemical in-flow tracers are commonly used for monitoring production fluids. Specifically, the use of chemical in-flow tracers in methods for determining the amount of water and distinguishing water from the oil phase are known in the art. Also, methods for water breakthrough detection of a single well may involve chemical in-flow tracers installed subsurface within the well, e.g. at or around a borehole.

It is known in the art to use chemical in-flow tracers for downhole production logging, i.e. subsurface monitoring of oil and/or water quantities produced from different parts of a single well or well completion. Chemical in-flow tracers are extensively used in downhole applications in oil and gas industry for identifying and quantifying the production of oil, gas and water from different reservoir parts of a single well or well completion. In addition, also the use of chemical in-flow tracers capable of being differentiated for detecting different fluids or fluid phases in a production fluid are known.

For example, U.S. Pat. No. 6,016,191 relates to an apparatus and its use for fluid flow analysis. U.S. Pat. No. 6,016,191 discloses a probe which is coupled to a light source configured to detect either reflectance or fluorescence. A fluorescent chemical tracer is injected into the fluid stream. The probe will then detect either oil or water in the stream based on the reaction of the fluids with the dye.

Further, U.S. Pat. No. 7,469,597 relates to a method for measuring the total phase volumes in multiphase fluid flow, wherein chemical tracers are injected into a pipeline. The concentration of the chemical tracers is measured as a function of time at the point of injection and at one or more downstream measurement points. The volumes are subsequently calculated based on the concentration of injected tracers and the tracer concentration measured in each phase at the respective measurement points.

The scientific publication "*Liquid Accumulation in Gas Condensate Pipelines Measured by use of Tracer Techniques*" by Sira et al. (https://www.onepetro.org/conference-paper/BHR-2005-G5) discloses the use of radioactive tracers for measuring the water content in gas-condensate pipelines.

U.S. Pat. No. 6,645,769 relates to a method for monitoring hydrocarbon and water production from different production zones/sections in a hydrocarbon reservoir and/or injection wells. The method includes dividing regions around wells in the reservoir into a number of zones/sections and injecting or placing specific tracers with unique characteristics for each zone/section into the formation such that tracers are placed as integrated parts of the well completion. Further, the method includes detecting the tracers downstream to provide information about the various zones/section.

U.S. Pat. No. 7,347,260 relates to a method for recovering materials injected into oil wells using a portable device, wherein the injected materials may comprise chemical tracers which may react with fluid components such as water. The detection of one or more tracers is performed at the wellhead surface, wherein the presence of one tracer may indicate the presence of water.

U.S. Pat. No. 7,805,248 B2 refers to a system and a method for estimating an occurrence of water breakthrough in a single production well. The method includes estimating the amount of water in the fluid produced at the at least one production zone and estimating the occurrence of the water breakthrough utilizing a trend of the estimated amount of water. The amount of water may be estimated by the use and detection of chemical tracers. U.S. Pat. No. 7,805,248 B2 discloses that the production zone may include a plurality of production zones, such as an upper production zone and a lower production zone.

However, the above-mentioned systems and methods for water breakthrough detection currently known in the art bear the risk of late water breakthrough detection, or no detection at all. This may negatively affect well production rates and can even lead to reservoir loss or damages to the production well equipment. A major drawback of current methods for water breakthrough detection is that they rely on sampling of the production fluid at the well location under or close to the surface. As outlined above, water breakthrough detection is currently addressed in the art by wellhead sampling wherein the water content in the production fluid is measured directly. However, wellhead sampling may be impractical and requires wellhead exposure, which in turn implies risks to health, safety and the environment. Alternatives to wellhead sampling may be other well testing methods such as test separation, or multi-phase metering. However, the two latter methods rely on regular testing with expensive equipment: in case of large fields with hundreds of wells, frequent testing for water breakthrough detection is not possible and wells might be tested only a few times per year. Besides, detection levels might be insufficient to detect water, at least until it has reached higher percentages, at which time it might be too late to react upon water breakthrough. In addition, current methods involving chemical in-flow tracers which are installed subsurface as integrated parts of a well completion, require well interventions or run-in-hole operations for placing the chemical in-flow tracers within the well. Also, systems and methods known in the art relate to water breakthrough detection of single wells only. Furthermore, systems and methods currently known in the art are associated with time-consuming and costly production fluid testing or expensive well-head instrumentation.

Accordingly, there is demand of a system and a method for reliably detecting water breakthrough which would allow for frequent sampling of multiple production wells or well strings simultaneously at a centralized downstream location, e.g. at the level of the main production line. It would be desirable to significantly increase sampling and measurement frequency and to facilitate simultaneous early water breakthrough detection for multiple production wells or well strings. Specifically, it is desirable to provide for a system and method for detecting water breakthrough which do not require well intervention or run-in-hole operations for injecting or placing chemical tracers within the well.

In other words, there is demand of a system and method for detecting water breakthrough allowing for detecting water breakthrough of multiple wells or well strings simultaneously at a centralized downstream location, e.g. at the level of the main production line. Specifically, it would be desirable to provide for a system and a method for detecting water breakthrough using chemical in-flow tracers being installed at the surface allowing for simultaneous water breakthrough detection of multiple wells or well strings, wherein the one or more wells suffering from water breakthrough are identified.

SUMMARY OF THE INVENTION

The present invention relates to a system and a method for detecting water breakthrough at an oil and/or gas production site, wherein two or more oil and/or gas producing wells and/or well strings are simultaneously monitored for water breakthrough at a centralized location downstream from the wells and/or well strings, preferably at the level of the main production line, and wherein one or more tracer component(s) each comprising one or more chemical in-flow tracer(s) are utilized for monitoring water breakthrough in the wells and/or well strings, the tracer components being located at the surface of the wells and/or well strings e.g. at the level of the wellheads, at the level of the flow lines, or at the level of the main production line.

In one aspect, the present invention relates to a system and method for detecting water breakthrough at an oil and/or gas production site comprising two or more oil and/or gas producing wells and/or well strings. In yet another aspect, the present invention relates to a system and a method for detecting water breakthrough, wherein one or more chemical in-flow tracer(s) are exposed to the gas and/or oil produced from the two or more wells and/or well strings in one or more tracer component(s). In a further aspect, the present invention relates to a system and a method for detecting water breakthrough, wherein one or more tracer component(s) comprising one or more chemical in-flow tracer(s) are located at the surface of the wells and/or well strings such as at the level of the two or more well heads, at the level of the two or more flow lines upstream of the manifold, at the level of the production manifold or at the level of the main production line. In a further aspect according to the present invention one tracer component comprising one or more chemical in-flow-tracer(s) is utilized per well or well string. In another aspect according to the present invention one tracer component comprising one or more chemical in-flow-tracer(s) is/are utilized for two or more wells or well strings but not for all wells or well strings.

In yet another aspect, the present invention relates to a system and a method for detecting water breakthrough at an oil and/or gas production site, wherein the presence of water in the gas and/or oil produced by a production well or well string is detected. The presence of water in the gas and/or oil produced by a production well or well string is indicated by the presence of a chemical in-flow tracer. A chemical in-flow tracer for indicating the presence of water, i.e. a water phase in the gas and/or oil produced by a production well or well completions, is soluble in water and thus comprised by the water comprised in the produced gas and/or oil. The presence of a chemical in-flow tracer is indicated by detecting the chemical in-flow tracer at a centralized location downstream from the wells and/or well strings, preferably at the level of the main production line.

In yet another aspect, the present invention relates to a system and a method for detecting water breakthrough at an oil and/or gas production site, wherein one or more chemical in-flow tracer(s) is/are exposed to the gas and/or oil produced from the two or more wells and/or well strings in one or more tracer component(s). In another aspect, the present invention relates to a system and a method for detecting water breakthrough at an oil and/or gas production site, wherein one tracer component comprising one or more chemical in-flow-tracer(s) is utilized per well or well string, wherein the one or more tracer components comprising the one or more chemical in-flow-tracer(s) is/are located at the surface of the wells and/or well strings, preferably, at the level of the two or more well heads, at the level of the two or more flow lines upstream of the manifold, at the level of the production manifold or at the level of the main production line, most preferably wherein the one or more tracer component(s) comprising the one or more chemical in-flow-tracers is/are located at the level of the two or more flow lines upstream of the manifold.

For a detailed understanding of the present invention, reference should be made to the following detailed description in conjunction with the drawings and embodiments according to the present invention.

DETAILED DESCRIPTION OF THE INVENTION

Figure 1:
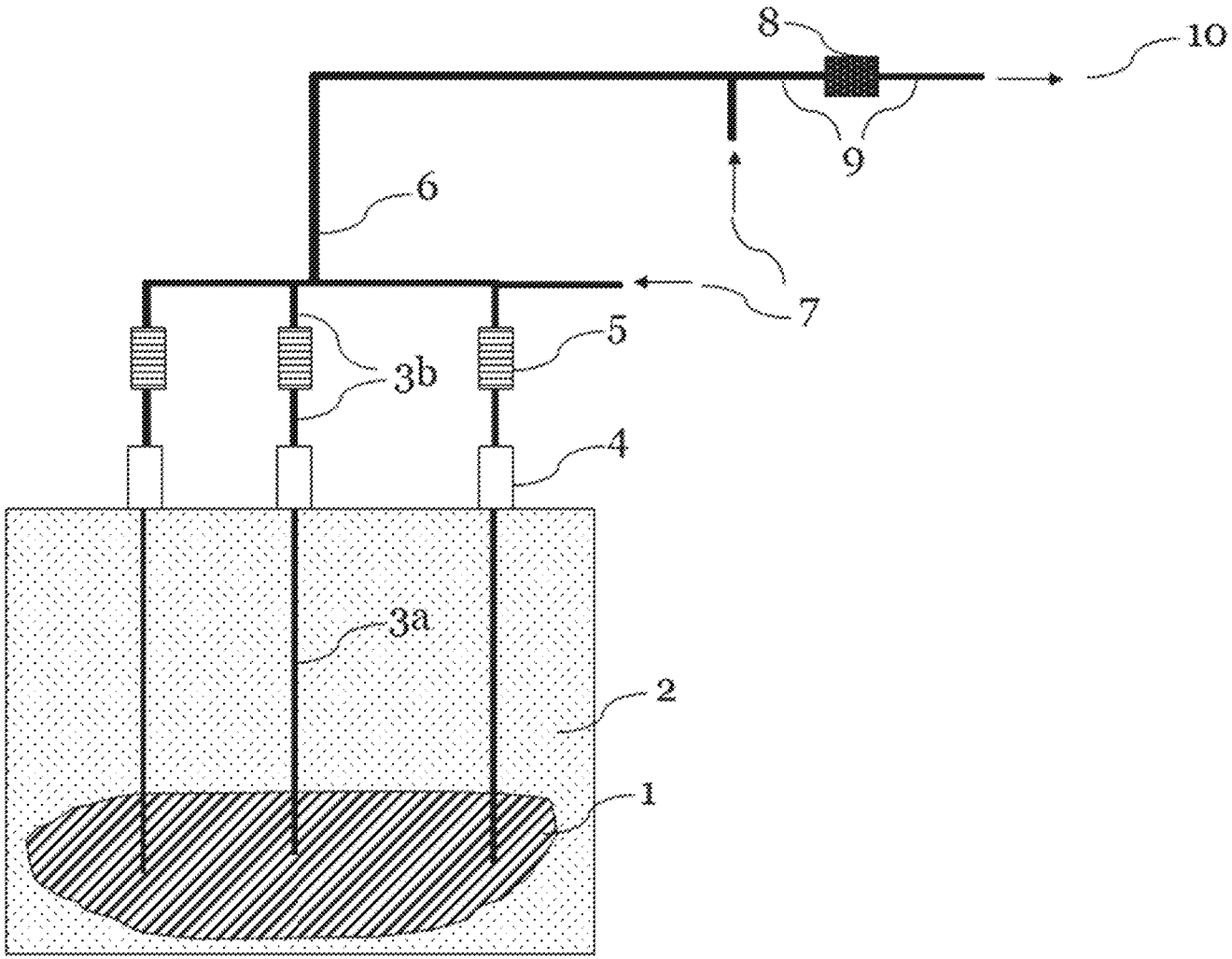
FIG. 1 shows an oil and/or gas production site comprising a) two or more oil and/or gas producing wells or well strings, b) two or more production tubings 3*a* producing the gas and/or oil 10 from a reservoir 1 in a geological formation 2, c) two or more wellheads 4, d) two or more flow lines 3*b* conveying the produced gas and/or oil 10, e) one or more tracer components 5 each comprising one or more chemical in flow tracer(s), f) one or more manifold(s) 6 combining the two or more flow lines 3*b, g*) optionally inlets from additional production wells 7, g) a downstream main production line 9 producing the gas and/or oil 10 from the one or more manifold(s) 6, wherein a detecting device, sampling point or sampling system 8 for the detection of the one or more chemical in-flow tracers is located at the level of the downstream main production line 9.
Figure 2:
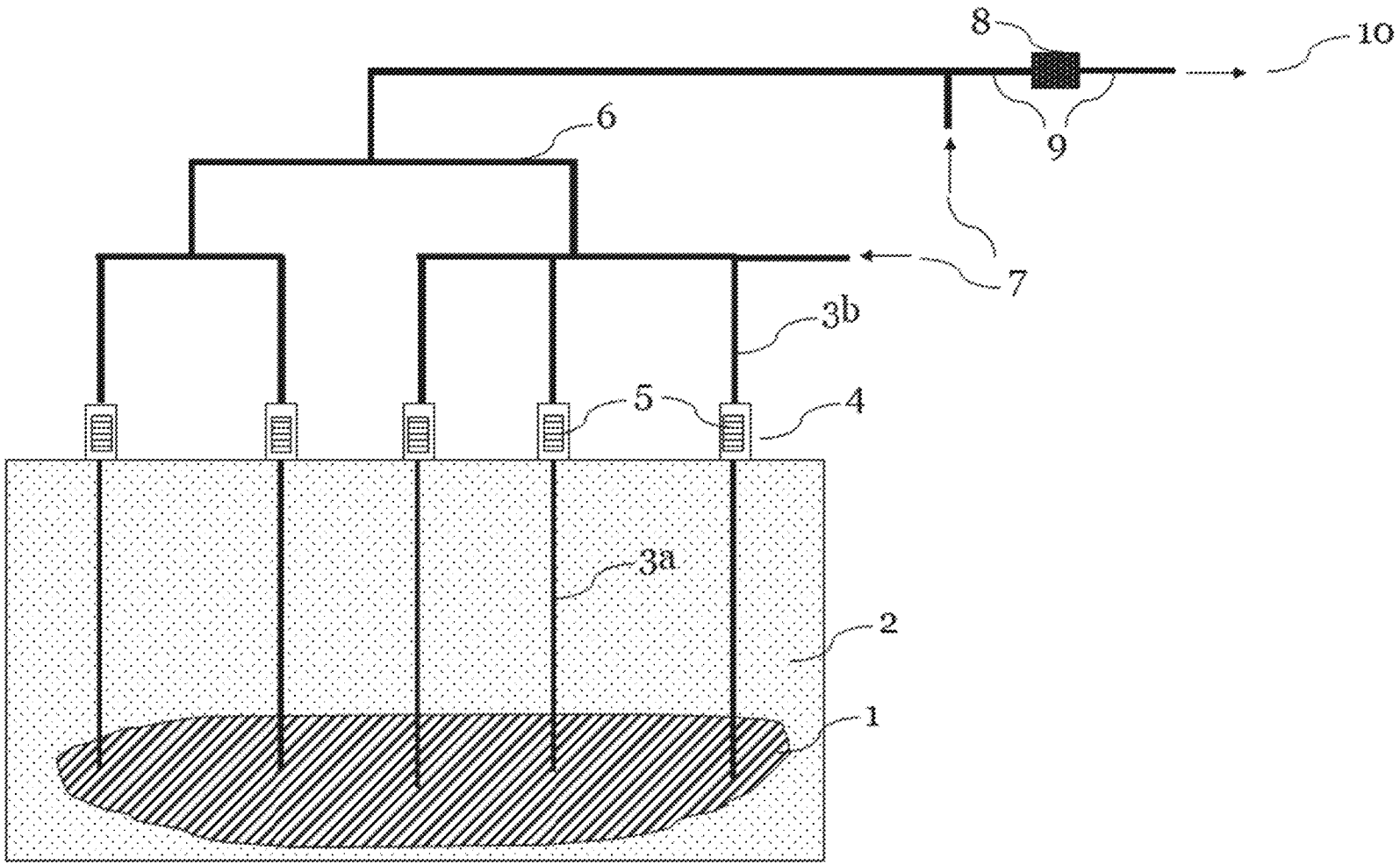
FIG. 2 shows an oil and/or gas production site according to FIG. 1, wherein the tracer components 5 are located at the level of the well heads 4.
Figure 3:
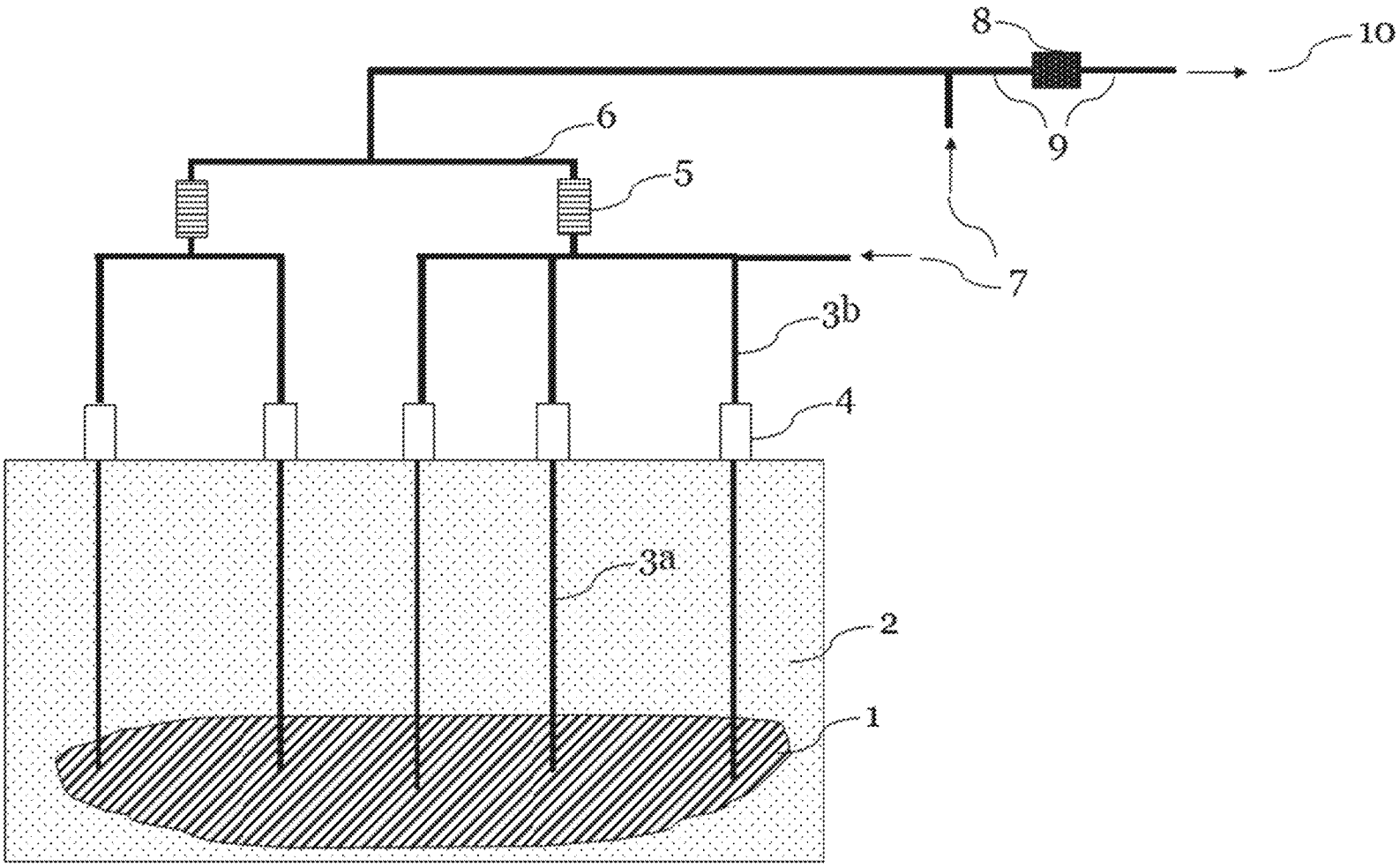
FIG. 3 shows an oil and/or gas production site according to FIG. 1, comprising tracer components 5 located at the level of the production manifold 6, wherein the tracer components 5 allow for simultaneously detecting water breakthrough at two or more wells.
Figure 4:
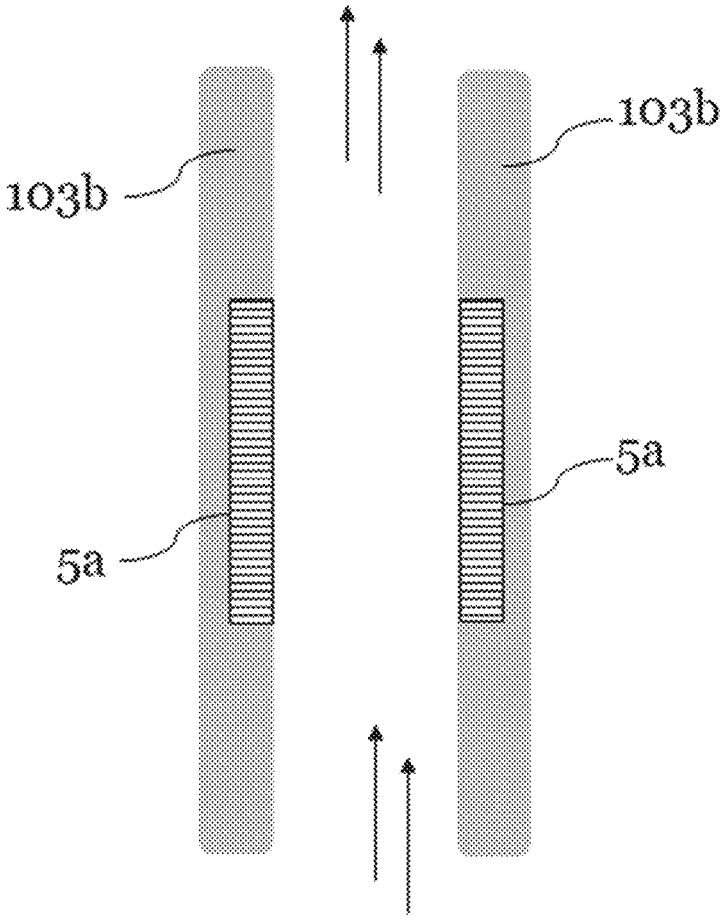
FIG. 4 shows a tracer component 5, wherein a chemical in-flow tracer is installed as a flow-line insert 5*a* in the jacket 103*b* of the flow line 3*b*, wherein the chemical in-flow tracer is exposed to the gas and/or oil being produced.
Figure 5:
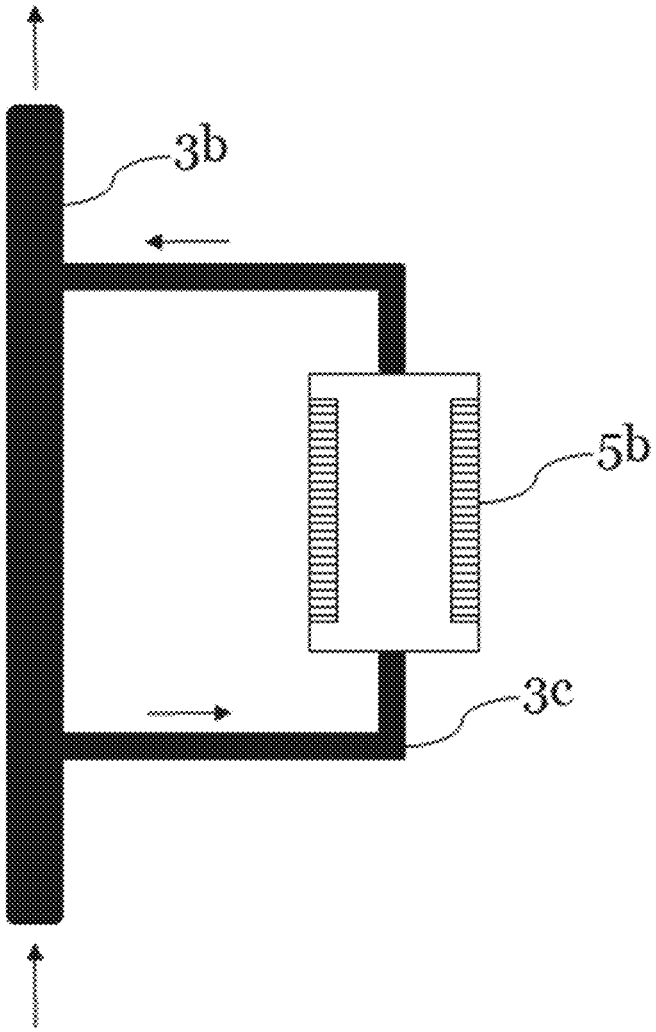
FIG. 5 shows a tracer component 5, wherein a chemical in-flow tracer is installed in a trace chamber 5*b* being connected to a flow line 3*b* via tubings 3*c* allowing for fluid communication between the trace chamber 5*b* and the flow line 3*b*, allowing for exposure of the one or more chemical in-flow tracer(s) to the gas and/or oil in the trace chamber 5*b*.
Figure 6:
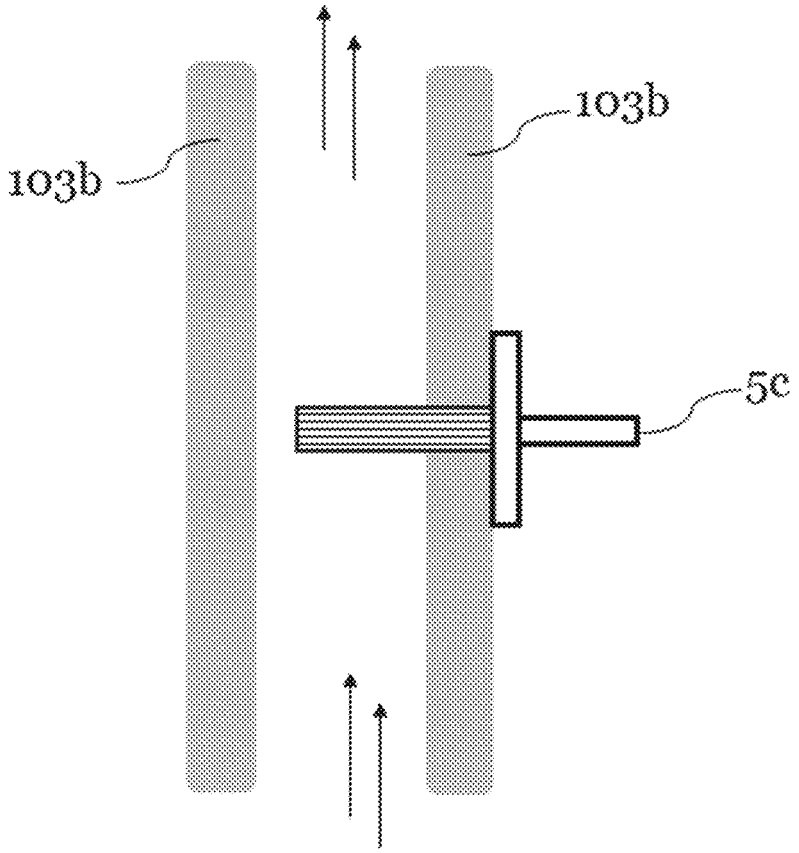
FIG. 6 shows a tracer component 5, wherein an inserted coupon 5*c* comprising the one or more chemical in-flow tracer(s) is installed in the jacket 103*b* of the flow line 3*b* and wherein the inserted coupon 5*c* comprising the one or more chemical in-flow tracer is exposed to the gas and/or oil being produced.

The system according to the present invention for detecting water breakthrough at an oil and/or gas production site comprising a) two or more oil and/or gas producing wells and/or well strings, b) two or more production tubings 3*a* producing the gas and/or oil 10 from a reservoir 1 in a geological formation 2, c) two or more wellheads 4, d) one or more manifold(s) 6 combining two or more flow lines 3*b, e*) optionally inlets from additional production wells 7, f) a downstream main production line 9 producing the gas and/or oil 10 from the one or more manifold(s) 6, wherein the system comprises:

(i) one or more tracer component(s) 5 each comprising one or more chemical in-flow tracer(s);

(ii) a detecting device, sampling point or sampling system 8 for the detection of the one or more chemical in-flow tracer(s).

The term "chemical in-flow tracer" according to the present invention refers to a chemical compound having such individual chemical and physical characteristics that allow for being differentiated against other chemical in-flow tracers or components of productions fluids the chemical in-flow tracer is comprised in. The chemical in-flow tracers according to the present invention allow for being specifically and individually detected due to a high recognition factor. A high recognition factor refers to individual chemical and physical characteristics which are different for each chemical in-flow tracer and which also differ from components of the production fluids the chemical in-flow tracers are comprised in. Chemical characteristics refer to, e.g. the chemical behavior of the chemical in-flow tracers in specific test reactions. Physical characteristics refer to physical properties of the chemical in-flow tracers, such as e.g. spectroscopic properties or solubility properties. In other words, chemical in-flow tracers allow for being discriminated against each other as well as against components of the production fluids the chemical in-flow tracers are comprised in.

The chemical in-flow tracers for a use in a system or a method according to the present invention dissolve specifically well in water and must not dissolve in the gas and/or oil produced from a well and/or well string. Thus, the presence of a chemical in-flow tracer in gas and/or oil produced from a well and/or well string indicates the presence of water in the gas and/or oil, i.e. a water breakthrough at the well or well string.

Chemical in-flow tracers for a use in a system or a method according to the present invention are all chemical compounds that dissolve only in water and not in oil or gas phases. Preferably, the chemical in-flow tracers for a use in a system or a method according to the present invention are chemical in-flow tracers typically known in the art such as dyes, pigments, colorants or radioactive compounds.

Chemical in-flow tracers for a use in a system or a method according to the present invention may be contained in a solid support and will be released upon exposure to a production fluid comprising water. A solid support may by any solid support for chemical in-flow tracers known in the art such as—but not limited to—a polymer support.

The one or more chemical in-flow tracer(s) is/are exposed to the production fluid(s) in one or more tracer component(s) 5, wherein the one or more tracer component(s) 5 is/are a flow-line insert 5*a*, a trace chamber 5*b*, an inserted coupon 5*c* or any combination thereof.

The detecting device, sampling point or sampling system 8 allow for manual sampling and/or on-line analysis, wherein the detecting device 8 for the detection of the one or more chemical in-flow tracer(s) is selected from the group consisting of a UV-vis spectrometer, an IR spectrometer, a mass spectrometer, or any combination thereof.

For an oil and/or gas production site comprising two or more oil and/or gas producing wells or well strings, the water breakthrough detection system according to the present invention comprises one or more tracer component(s) 5 each comprising one or more chemical in-flow tracer(s), wherein one tracer component 5 comprising one or more chemical in-flow-tracer(s) is utilized per well or well string, or wherein one tracer component 5 comprising one or more chemical in-flow-tracer(s) is utilized for two or more wells but not for all wells. Thereby the system and the method according to the present invention provide for assignment of the one or more chemical in-flow tracer(s) to one particular well or well string, or to one particular group of wells or well strings, respectively. The presence of the one or more chemical in-flow tracer(s) comprised in the produced oil or gas 10 at the level of the two or more well head(s) 4, the two or more flow lines 3*b* upstream of the manifold 6, or the downstream main production line 9 allows for determining which specific well or well string or which specific group of wells or well strings is suffering from water breakthrough. Consequently, if several production fluids comprising one or more chemical in-flow tracer(s) from different wells or well strings are combined in the downstream main production line 9, different chemical in-flow tracers allow for simultaneous and centralized determination of the one or more well(s) or well string(s) which is/are suffering from a water breakthrough.

Embodiments

An embodiment according to the present invention relates to a system for detecting water breakthrough at an oil and/or gas production site comprising a) two or more oil and/or gas producing wells and/or well strings, b) two or more production tubings 3*a* producing the gas and/or oil 10 from a reservoir 1 in a geological formation 2, c) two or more wellheads 4, d) one or more manifold(s) 6 combining two or more flow lines 3*b, e*) optionally inlets from additional production wells 7, f) a downstream main production line 9 producing the gas and/or oil 10 from the one or more manifold(s) 6, wherein the system comprises:

(i) one or more tracer component(s) 5 each comprising one or more chemical in-flow tracer(s);

(ii) a detecting device, sampling point or sampling system 8 for the detection of the one or more chemical in-flow tracer(s).

A preferred embodiment according to the present invention relates to a system for detecting water breakthrough, wherein one tracer component 5 comprising one or more chemical in-flow-tracer(s) is utilized per well or well string. In another embodiment according to the present invention one tracer component 5 comprising one or more chemical in-flow-tracer(s) is utilized for two or more wells or well strings but not for all wells or well strings. This allows for water breakthrough detection of two or more wells simultaneously at a centralized location of the production site downstream from the wells and/or well strings, preferably at the level of the main production line 9. Thereby sampling and measurement frequencies are significantly increased and thus early water breakthrough detection for a plurality of wells is facilitated.

An even more preferred embodiment according to the present invention relates to a system for detecting water breakthrough, wherein the one or more tracer component(s) 5 each comprising one or more chemical in-flow-tracer(s) is/are located at the surface of the wells and/or well strings, preferably at the level of the two or more well heads 4, at the level of the two or more flow lines 3*b* upstream of the one or more manifolds 6, at the level of the one or more manifolds 6, or at the level of the main production line 9, preferably, wherein the one or more tracer component(s) 5 each comprising one or more chemical in-flow-tracer(s) is/are located at the level of the two or more flow lines 3*b* upstream of the one or more manifolds 6, and wherein the one or more tracer component(s) 5 allow for the one or more chemical in-flow-tracer(s) being exposed to gas and/or oil 10 produced from the two or more wells and/or well strings in the tracer component 5.

This provides for a system for detecting water breakthrough which does not require well intervention or run-in-hole operations for injecting or placing the one or more chemical in-flow tracer(s) within the well or well string. Accordingly, this allows for simplified handling and maintenance since laborious run-in-hole operations are superseded, and concurrently, risks to health, safety and the environment are decreased.

Another embodiment according to the present invention relates to a system for detecting water breakthrough, wherein the one or more tracer component(s) 5 each comprising one or more chemical in-flow-tracer(s) is/are a flow-line insert 5*a*, a trace chamber 5*b*, an inserted coupon 5*c* or any combination thereof. This allows for the one or more chemical in-flow tracer(s) to be in fluid communication with gas and/or oil 10 produced by a well or well string and to dissolve in water comprised in the gas and/or oil 10. This provides for water being detected.

Another embodiment according to the present invention relates to a system for detecting water breakthrough, wherein the presence of water in gas and/or oil 10 produced from the two or more wells and/or well strings is indicated by the presence of one or more chemical in-flow tracer(s) comprised by the water phase being present in the gas and/or oil 10. A further embodiment according to the present invention relates to a system for detecting water breakthrough, wherein the presence of one or more chemical in-flow tracer(s) comprised by the water phase being present in the gas and/or oil 10 is indicated by detecting the chemical in-flow tracer at a centralized location downstream from the wells and/or well strings, preferably at the level of the main production line 9.

A further embodiment according to the present invention relates to a system for detecting water breakthrough comprising one or more tracer component(s) 5 each comprising one or more chemical in-flow tracer(s), wherein the one or more chemical in-flow tracer(s) is/are chemical in-flow tracers typically known in the art such as dyes, pigments, colorants or radioactive compounds.

In another embodiment according to the present invention, the one or more chemical in-flow tracer(s) is/are contained in a solid support. A solid support may by any solid support for chemical in-flow tracers known in the art such as—but not limited to—a polymer support. This allows for release of the chemical in-flow tracer from the solid support into the water phase upon exposure to a production fluid comprising water.

A further embodiment according to the present invention relates to a system for detecting water breakthrough, wherein one or more chemical in-flow tracer(s) is/are detected by means of a detecting device 8 or via manual sampling at a downstream sampling point 8 or sampling system 8 and subsequent analysis. A preferred embodiment according to the present invention relates to a system for detecting water breakthrough, wherein the detecting device 8 is selected from the group consisting of UV-vis spectrometer, IR spectrometer, mass spectrometer, or any combination thereof. Yet another preferred embodiment according to the present invention relates to a system for detecting water breakthrough, wherein one or more chemical in-flow tracer(s) is/are detected by a detecting device, sampling point or sampling system 8 allowing for manual sampling and/or on-line analysis.

This provides for a frequent sampling of multiple production wells at the same time and therefore significantly increases sampling and measurement frequency.

In a preferred embodiment according to the present invention, detection of one or more chemical in-flow tracer(s) is carried out at a centralized location downstream from the wells and/or well strings, preferably at the level of the main production line 9. This allows for simultaneous monitoring of multiple production wells or well completions of a production site and therefore significantly increases sampling and measurement frequency. Also, early water breakthrough detection for one or more particular well(s) of a plurality of wells is facilitated.

A most preferred embodiment according to the present invention is a system for detecting water breakthrough at an oil and/or gas production site comprising two or more wells or well strings, wherein one tracer component 5 comprising one or more chemical in-flow-tracer(s) is utilized per well or well string, wherein each of the tracer components 5 is located at the level of the two or more flow lines 3*b* upstream of the one or more manifold(s) 6, wherein each of the tracer components 5 allows for the one or more chemical in-flow-tracer(s) being exposed to gas and/or oil 10, wherein each of the tracer components 5 is a flow-line insert 5*a*, and wherein the detection of the one or more chemical in-flow tracer(s) is carried out simultaneously and at a centralized location downstream from the wells and/or well strings, preferably at the level of the main production line 9.

Other embodiments according to the present invention relate to a method for detecting water breakthrough, wherein a system according to any of the above-mentioned embodiments is used.

Another embodiment according to the present invention relates to a method for detecting water breakthrough, wherein the presence of water in gas and/or oil 10 produced from the two or more wells and/or well strings is indicated by the presence of one or more chemical in-flow tracer(s) comprised by the water phase being present in the gas and/or oil 10.

A preferred embodiment according to the present invention relates to a method for detecting water breakthrough, wherein one tracer component 5 comprising one or more chemical in-flow-tracer(s) is utilized per well or well string. In another embodiment according to the present invention one tracer component 5 comprising a chemical inflow-tracer is utilized for two or more wells or well strings but not for all wells or well strings.

A further embodiment according to the present invention relates to a method for detecting water breakthrough, wherein one or more tracer component(s) 5 each comprising one or more chemical in-flow tracer(s) are utilized, wherein the one or more chemical in-flow tracer(s) is/are chemical in-flow tracers typically known in the art such as dyes, pigments, colorants or radioactive compounds.

A further embodiment according to the present invention relates to a method for detecting water breakthrough, wherein one or more chemical in-flow tracer(s) is/are detected by means of a detecting device 8 or via manual sampling at a downstream sampling point 8 or sampling system 8 and subsequent analysis. A preferred embodiment according to the present invention relates to a method for detecting water breakthrough, wherein the detecting device 8 is selected from the group consisting of UV-vis spectrometer, IR spectrometer, mass spectrometer, or any combination thereof. Yet another preferred embodiment according to the present invention relates to a method for detecting water breakthrough, wherein one or more chemical in-flow tracer(s) is/are detected by a sampling point or sampling system 8 allowing for manual sampling and/or on-line analysis.

A most preferred embodiment according to the present invention relates to a method for detecting water breakthrough at an oil and/or gas production site comprising two or more wells or well strings, wherein one tracer component 5 comprising one or more chemical in-flow-tracer(s) is utilized per well or well string, wherein each of the tracer components 5 is located at the level of the two or more flow-lines 3*b* upstream of the one or more manifold(s) 6, wherein each of the tracer components 5 allow for the one or more chemical in-flow-tracer(s) being exposed to gas and/or oil 10, wherein each of the tracer components 5 is a flow-line insert 5*a*, and wherein the detection of the one or more chemical in-flow tracer(s) is carried out simultaneously and at a centralized location downstream from the wells and/or well strings, preferably at the level of the main production line 9.

A further embodiment according to the present invention relates to the use of a system according to any of the above embodiments in a method for detecting water breakthrough according to any of the above embodiments.

The invention claimed is:

1. A system for detecting water breakthrough at an oil and/or gas production site comprising a) two or more oil and/or gas producing wells and/or well strings, b) two or more production tubings producing the gas and/or oil from a reservoir in a geological formation, c) two or more well-heads, d) one or more manifold(s) combining two or more flow lines, e) optionally inlets from additional production wells, f) a down-stream main production line producing the gas and/or oil from the one or more manifold(s), wherein the system comprises:

(i) one or more tracer component(s) each comprising one or more chemical in-flow tracer(s), wherein the one or more tracer component(s) is/are a trace chamber, an inserted coupon, or any combination thereof, wherein the trace chamber is connected to the two or more flow lines via two or more tubings allowing for fluid communication between the trace chamber and the two or more flow-lines, allowing for exposure of the one or more chemical in-flow tracer(s) to the gas and/or oil in the trace chamber, and/or wherein the inserted coupon comprising the one or more chemical in-flowtracer(s) is installed in a jacket of the one or more flow-lines and wherein the inserted coupon comprising the one or more chemical in-flow tracer(s) is exposed to the gas and/or oil being produced; and (ii) a detecting device, sampling point or sampling system for the detection of the one or more chemical in-flow tracer(s).

2. The system according to claim 1, wherein one tracer component comprising one or more chemical in-flowtracer(s) is utilized per well or well string.

3. The system according to claim 1, wherein one tracer component comprising one or more chemical in-flowtracer(s) is utilized for two or more wells or well strings but not for all wells or well strings.

4. The system according to claim 1, wherein the one or more tracer component(s) each comprises one or more chemical in-flowtracer(s) located at the level of the two or more flow lines upstream of the one or more manifold(s).

5. The system according to claim 1, wherein the one or more tracer component(s) allow for the one or more chemical in-flowtracer(s) being exposed to gas and/or oil produced from the two or more wells and/or well strings in the tracer component.

6. The system according to claim 1, wherein the one or more chemical in-flow tracer(s) is/are contained in a solid support.

7. The system according to claim 6, wherein the solid support is a polymer support.

8. The system according to claim 1, wherein the one or more chemical in-flow tracer(s) is/are detected by means of a detecting device or is/are detected via manual sampling at a downstream sampling point or sampling system and subsequent analysis.

9. The system according to claim 1, wherein the detecting device is selected from the group consisting of UV-vis spectrometer, IR spectrometer, mass spectrometer, or any combination thereof.

10. The system according to claim 1, wherein the detection of two or more chemical in-flow tracer(s) is carried out simultaneously.

11. The system according to claim 1, wherein the detecting device, sampling point or sampling system allow for manual sampling and/or on-line analysis.

12. The system according to claim 1, wherein the detection of the one or more chemical in-flow tracer(s) is carried out at a centralized location downstream from the wells and/or well strings.

13. The system according to claim 12, wherein the detection of the one or more chemical in-flow tracer(s) is carried out at the level of the main production line.

14. The system according to claim 1, wherein the detection of two or more chemical in-flow tracer(s) is carried out simultaneously and at a centralized location downstream from the wells and/or well strings.

15. The system according to claim 14, wherein the detection of the two or more chemical in-flow tracer(s) is carried out simultaneously and at the level of the main production line.

16. The system according to claim 1, wherein one tracer component comprising one or more chemical in-flowtracer(s) is utilized per well or well string, wherein each of the tracer components is located at the level of the two or more flow lines upstream of the one or more manifold(s), wherein each of the tracer components allow for the one or more chemical in-flow tracer(s) being exposed to gas and/or oil, wherein each of the tracer components is a flow-line insert, and wherein the detection of two or more chemical in-flow tracer(s) is carried out simultaneously and at a centralized location downstream from the wells and/or well strings.

17. The system according to claim 16, wherein the detection of the two or more chemical in-flow tracer(s) is carried out simultaneously and at the level of the main production line.

18. The system according to claim 1, wherein the one or more chemical in-flowtracer(s) is/are located at the level of the two or more well heads, at the level of the two or more flow lines upstream of the one or more manifolds, at the level of the one or more manifolds, or at the level of the main production line or any combination thereof.

* * * * *